US006469727B1

(12) United States Patent
Wada et al.

(10) Patent No.: US 6,469,727 B1
(45) Date of Patent: Oct. 22, 2002

(54) OPTICAL QUANTITY MEASURING METHOD AND OPTICAL QUANTITY MEASURING APPARATUS USING SAME

(75) Inventors: Kenichi Wada, Takatsuki (JP); Tomohiko Masuda, Takatsuki (JP); Yuji Kamoda, Ibaraki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/093,054

(22) Filed: Jun. 8, 1998

(30) Foreign Application Priority Data

Jun. 9, 1997 (JP) ..... 9-150721

(51) Int. Cl.[7] ..... B41J 2/47; B41J 29/393

(52) U.S. Cl. ..... 347/240; 347/130; 347/19

(58) Field of Search ..... 347/240, 251, 347/232, 235, 234, 248, 236, 250, 130, 19

(56) References Cited

U.S. PATENT DOCUMENTS 4,581,617 A * 4/1986 Yoshimoto et al. ..... 347/240
4,595,259 A * 6/1986 Perregaux ..... 350/331 R
6,014,154 A * 6/1986 Guerin ..... 347/116
4,827,281 A * 5/1989 Lubinsky et al. ..... 347/195
5,325,228 A 6/1994 Matsubara et al. ..... 355/68
5,450,165 A * 9/1995 Henderson ..... 355/208
5,532,727 A * 7/1996 Agano et al. ..... 347/240
5,623,300 A * 4/1997 Itoh et al. ..... 347/237
5,684,568 A 4/1997 Ishikawa et al. ..... 355/41
5,661,544 A 8/1997 Ishikawa et al. ..... 359/249
5,808,651 A * 9/1998 Horiuchi ..... 347/240
5,818,501 A * 10/1998 Ng et al. ..... 347/240
5,887,223 A * 3/1999 Sakai et al. ..... 399/60

FOREIGN PATENT DOCUMENTS

| | | |
|---|---|---|
| JP | 61150286 | 7/1986 |
| JP | 06347923 | 12/1994 |
| JP | 08137028 | 5/1996 |

* cited by examiner

*Primary Examiner*—Lamson Nguyen
(74) *Attorney, Agent, or Firm*—McDermott, Will & Emery

(57) ABSTRACT

Disclosed is a method for measuring light quantities emitted from an array of light shutter elements aligned in a main scan direction. The method measures the light quantities by scanning and sensing a recording paper on which an image is formed by the light shutter elements. The scan direction is orthogonal to a direction in the image corresponding to the main scan direction of the array.

15 Claims, 8 Drawing Sheets

OPTICAL QUANTITY MEASURING METHOD AND OPTICAL QUANTITY MEASURING APPARATUS USING SAME

CROSS REFERENCE APPLICATION

This application is based on Patent Application No. HEI 9-150721 filed in Japan, the content of which is hereby incorporated by reference.

BACKGROUND OF THE INVENTION

1. Field of the Invention

The present invention relates to an optical quantity measuring method or an optical quantity measuring apparatus for measuring optical quantity of an image on an image bearing member formed by using an array of image forming elements, such as PLZT light shutter array, LED array, an array of heat generating elements, or an array of ink drop expelling elements.

2. Description of the Related Art

Heretofore, various types of optical recording devices have been proposed which switch optical signal generating elements ON/OFF to form an image (latent image) on a photosensitive member. As to the photosensitive member, the electrophotographic photosensitive member, and the film or printing paper using a silver salt sensitive member are known. Known optical signal generating elements include optical shutter elements which switch ON/OFF the light emitted from a light source in accordance with an applied voltage, and LED elements which themselves generate light in accordance with an applied voltage. Well known optical shutter elements include elements formed of PLZT material, liquid crystal elements and the like. This type of optical recording device is constructed with a plurality of optical signal generating elements arranged in an array-like layout, and is referred to as a solid-state scanning-type optical recording device. This type of solid-state scanning-type optical recording device is constructed so as to allow adjustment (e.g., by modulation of the drive signal pulse width or voltage, changing the pulse train combination and the like) of the light quantity of each optical signal by measuring the amount of light of each optical signal generating element and correcting the amount of light of each element in accordance with the measured value.

Japanese Laid-Open Patent Application No. SHO 61-150286 discloses a light quantity measuring method for measuring the light quantity of optical signal generating elements for the purpose of correcting said light quantity. This publication discloses a construction providing a plurality of LED elements arrayed in the main scan direction, and discloses a method of measuring the amount of light of optical signals emitted by said LED elements by sequentially turning ON said LED elements in the main scan direction and detecting the amount of light emitted by each said LED element via a photodetector. The LED array extends in the main scan direction, and has markedly different lengths between the length from an LED element positioned at the center of the array to the photodetector, and the length from the LED element positioned at the ends of the array to the photodetector. Therefore, the photodetector detects the amount of light of the optical signals from the various LED elements under different distance conditions, thereby preventing high precision detection of the light quantity.

Another method considers moving the photodetector along the main scan direction and sequentially turning ON each LED element synchronously with said movement, but the LED element scanning speed and sensor moving speed must be accurately synchronized. The starting position of the photodetector must be finely adjusted. Thus, an encoder and precision moving mechanism are required, thereby greatly increasing the cost of the actinograph. Corrections with the device incorporated in an image forming apparatus were not conducted.

Methods of sequentially turning ON each optical signal generating element are disadvantageous in that the influence of light leakage from adjacent optical signal generating elements is not reflected in the measurement, and image irregularities are not adequately eliminated when reproducing solid images. Although consideration has been given to switching ON a plurality of optical signal generating elements simultaneously, the problem of identifying the position (addressing) of each optical signal generating element remains.

Other than optical signal generating elements, heat generating elements used in a thermal printer and ink drop expelling elements used in an ink jet printer also require similar correction to compensate irregularities among these elements.

SUMMARY OF THE INVENTION

A principal object of the present invention is to provide an improved optical quantity measuring apparatus or method. Another object of the present invention is to provide an optical quantity measuring apparatus or method capable of correcting the irregularities among image forming elements. Still further object of the present invention is to provide an optical quantity measuring apparatus or method capable of correcting the irregularities among image forming elements via a simple operation or simple construction.

To achieve at least one of the above mentioned objects, one aspect of the present invention essentially comprises (1) forming an image on an image bearing member by using an array of light signal emitting elements which are aligned in a first direction; and (2) sensing the intensity of the image by a photosensor with relatively moving the image bearing member to the photosensor in a direction which is orthogonal to a direction corresponding to the first direction. By relatively moving the image bearing member in the second direction, the photosensor successively senses portions of the image corresponding the light signal generating elements. The image may include first part for identifying positions of the light signal generating elements with respect to the first direction and second part for evaluating light quantities emitted from the light signal generating elements. The photosensor may include a first photosensing element for sensing the first part and a second photosensing element for sensing the second part.

The above identified aspect may be reflected in a method for measuring quantity of light emitted from an array of light signal generating arranged in a first direction, and in a measuring apparatus for measuring quantity of light emitted from an array of light signal generating arranged in a first direction.

DETAILED DESCRIPTION OF THE PREFERRED EMBODIMENTS

The preferred embodiments of the light quantity measuring method of the optical recording head and image forming apparatus of the present invention are described hereinafter with reference to the accompanying drawings.

Figure 1:
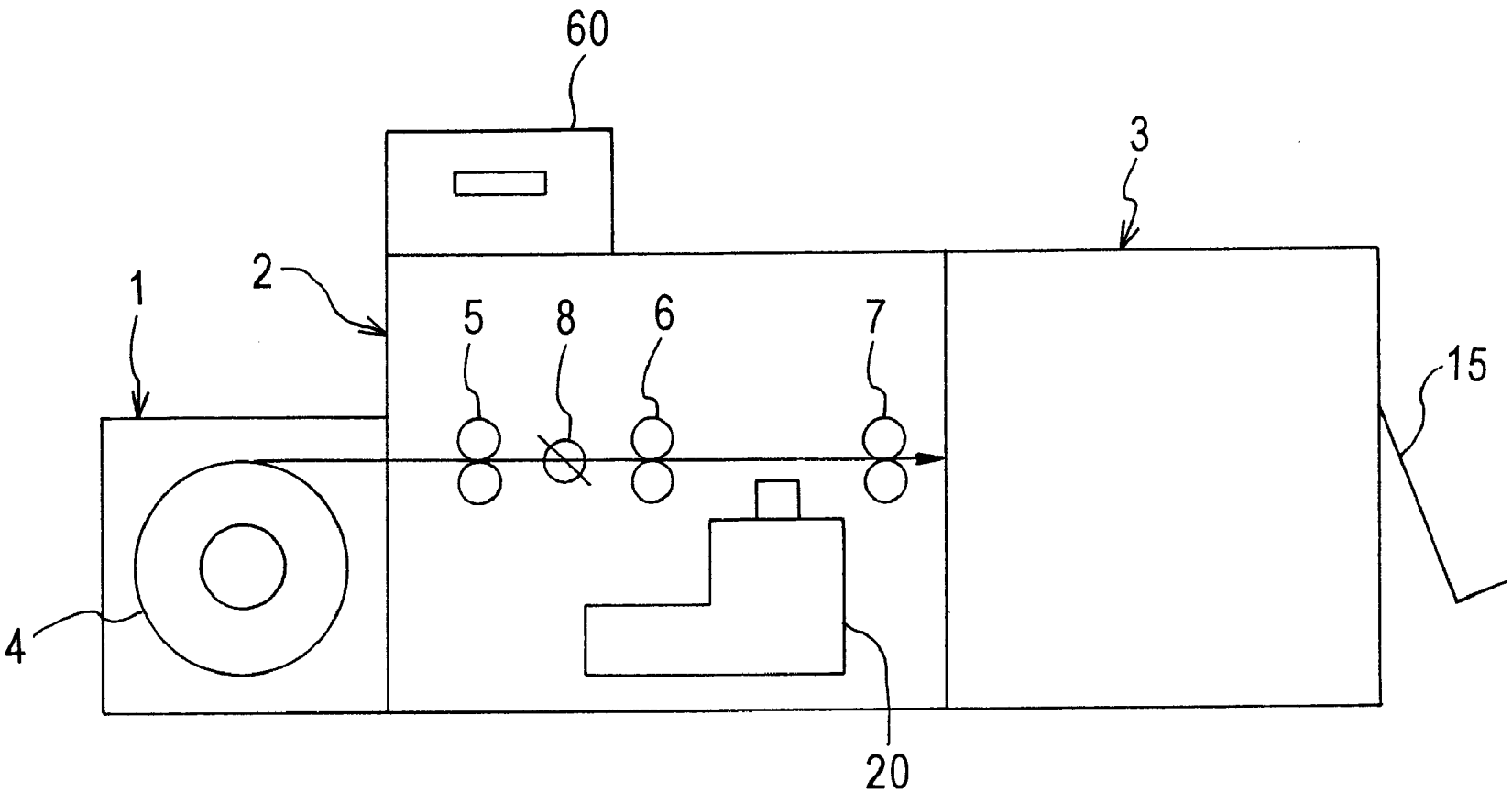
FIG. 1 briefly shows the construction of a full color printer in one embodiment of the present invention.

FIG. 1 briefly shows the construction of a color printer used for photographic printing. This color printer includes a printing paper storage unit 1, image forming unit 2, and processing unit 3. Printing paper storage unit 1 accommodates a roll-type continues sheet of printing paper 4. Image forming unit 2 includes the optical recording head 20 shown in FIG. 2, and is further provided with pairs of transport rollers 5, 6, and 7 which transport printing paper 4, and a cutter 8 which cuts printing paper 4 to a desired length. An image reading unit 60 is also provided above image forming unit 2.

Printing paper 4 is fed to the image forming unit 2 via the pair of transport rollers 5 with the photosensitive surface facing downward, and the rotation of the pair of transport rollers 5 is stopped when a prescribed length of said printing paper 4 has been fed, and the paper is cut by the operation of cutter 8. The cut printing paper 4 is transported at constant speed via pairs of rollers 6 and 7. When printing paper 4 passes above the optical recording head 20, and an image exposure is executed and thus a latent image is formed on the printing paper 4. After exposure, the printing paper 4 is developed by processing unit 3, and thereafter the sheet is stabilized and dried, then ejected to tray 15.

Figure 2:
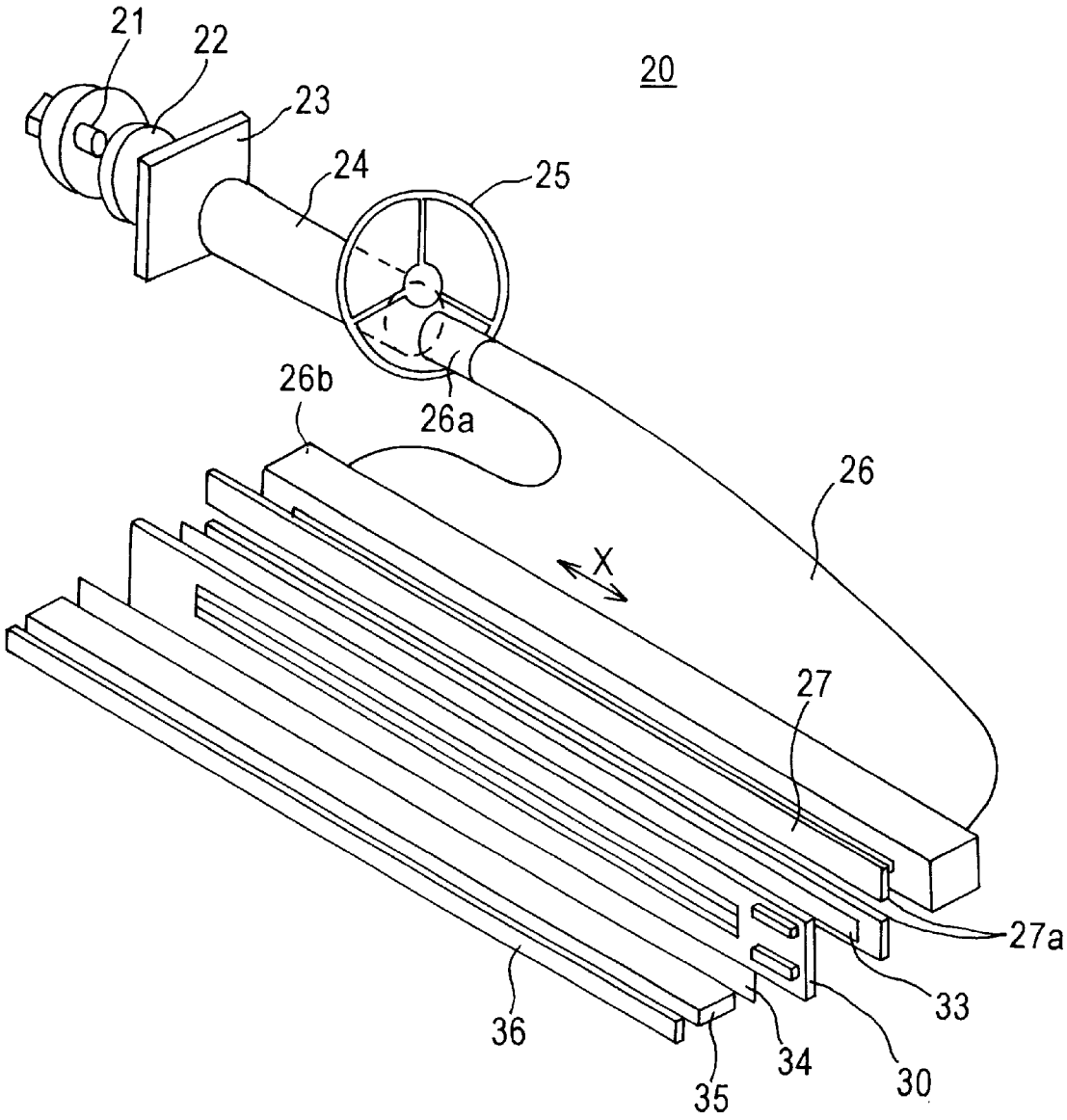
FIG. 2 is a perspective view of an optical recording head installed in the aforesaid printer.

Optical recording head 20, as shown in FIG. 2, briefly comprises halogen lamp 21, infrared cutting filter 22, color correction filter 23, diffusion tube 24, RGB filter 25, optical fiber array 26, slit panel 27, optical shutter module 30, polarizer 33, analyzer 34, image forming lens array 35, and dust-proof glass 36.

Light emitted by halogen lamp 21 passes through infrared cutting filter 22 to be cut the infrared component thereof. The quality of the infrared-filtered light is adjusted so as to match the spectral sensitivity characteristics of printing paper 4 via color correction filter 23. Diffusion tube 24 improves the usability of the light and reduces light emission irregularities of lamp 21. RGB filter 25 is driven in rotation synchronously with image recording via a plurality of optical shutter elements formed of PLZT described later, so as to change the light passing therethrough for each line.

Optical fiber array 26 is comprised of a plurality of optical fibers. End 26*a* of optical fiber array 26 is a bundled structure of said optical fibers, and is facing the aforesaid diffusion tube 24 through RGB filter 25. The other end 26*b* of said optical fiber array 26 is a structure arrayed in the main scan direction indicated by the X arrow, so as to emit light in a line. The slit edges 27*a*,27*a* of slit panel 27 have a mirror surface finish, so as to direct light emitted from optical fiber array 26 to optical shutter module 30 with high efficiency. A heater (not illustrated) is provided on slit panel 27 to maintain the optical shutter chips at a constant temperature; the temperature is controlled based on the detection results of a temperature sensor (not illustrated) provided on module 30.

Optical shutter module 30 is provided with a plurality of optical shutter chips comprising PLZT on a glass substrate or ceramic substrate having a slit-like opening, and further provided with a plurality of driver IC arranged with said optical shutter chips. Each optical shutter chip includes a plurality of optical shutter elements, and each optical shutter element comprises a pixel of a recorded image. Each driver ICs includes a plurality of driver circuits corresponding to said plurality of optical shutter elements, and each said driver circuit is connected to a corresponding optical shutter element. Only those optical shutter elements corresponding to predetermined pixels are driven by the driver ICs. This construction is described fully, for example, in U.S. patent application Ser. No. 5,325,228, the content of which is cited herein.

Figure 3:
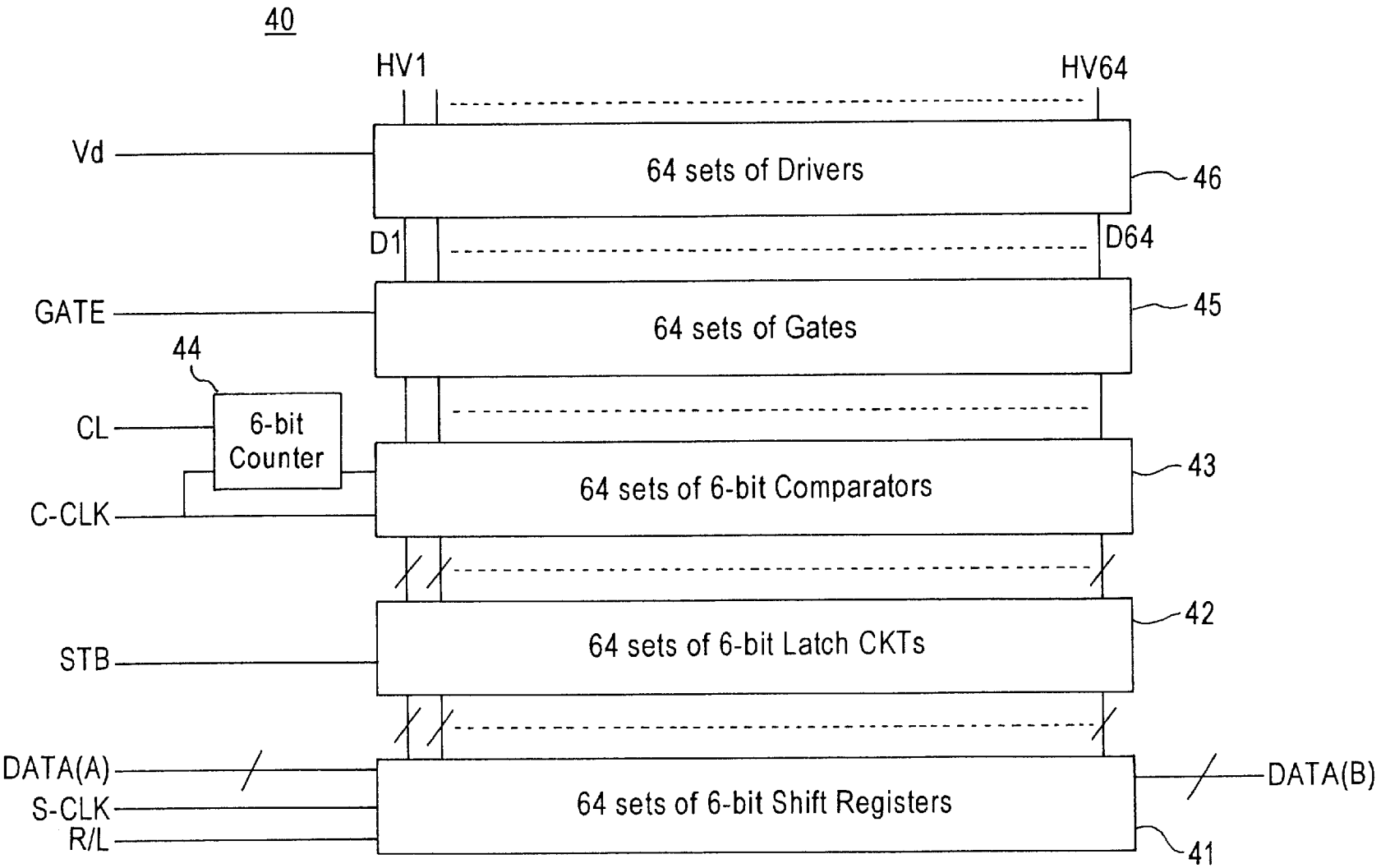
FIG. 3 is a block diagram of a driver IC used for multi-level reproduction.
Figure 4:
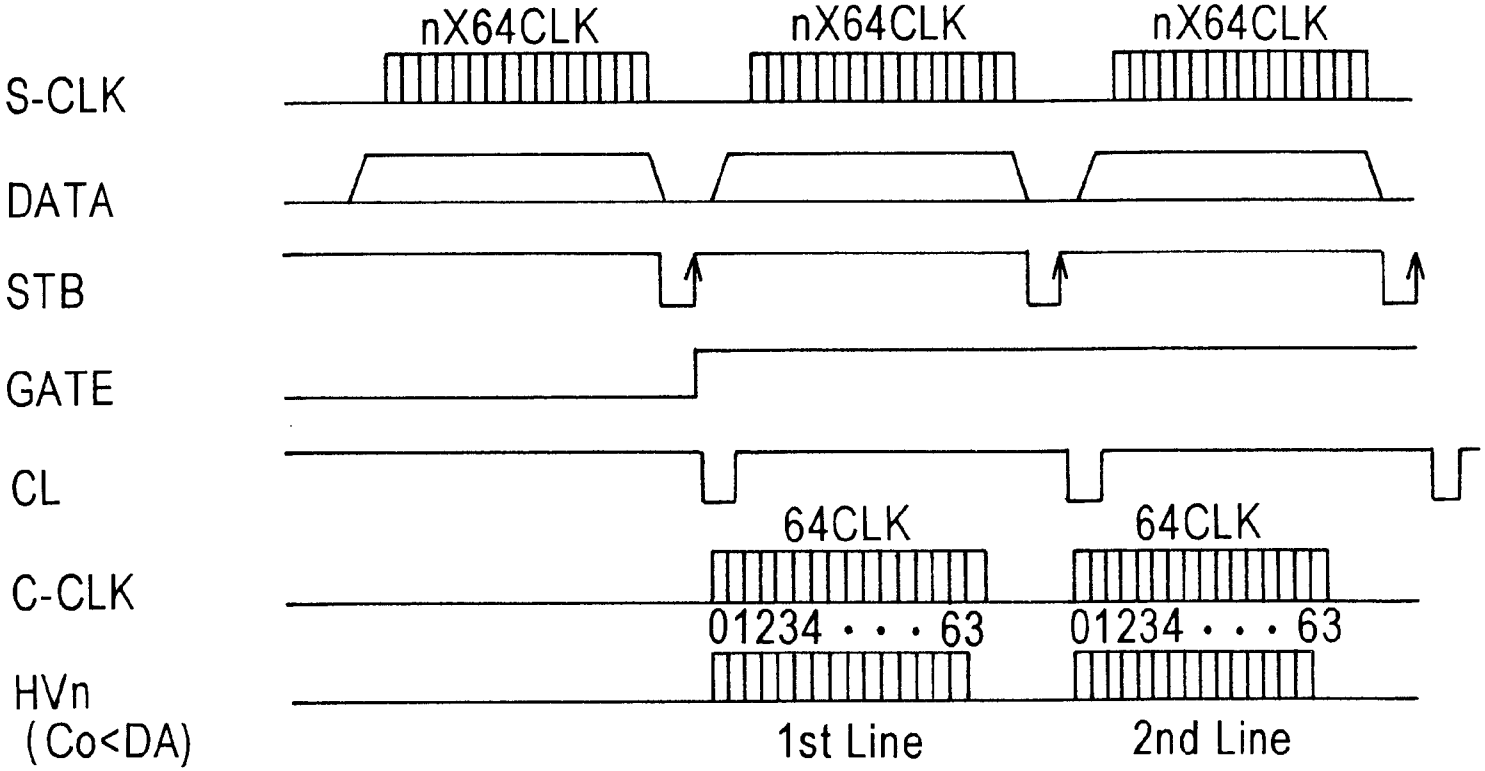
FIG. 4 is a timing chart of the operation of said driver IC.

The construction and drive timing of driver IC 40 used for multi-level image reproduction are described hereinafter with reference to FIGS. 3 and 4. FIG. 3 shows the construction of a driver IC 40, and FIG. 4 is a timing chart showing the drive timing of said driver IC 40. Driver IC 40 uses a ladder chain series of n individual integrated circuits (IC), and each IC 40 is constructed so as to actuate 64 dots, and is provided with 6-bit shift register 41, 6-bit latch circuit 42, 6-bit comparator 43, 6-bit counter 44, gate circuit 45, driver circuit 46. Image data DATA(A) and DATA(B) are transmitted to shift register 41 synchronously with a shift clock signal S-CLK based on the shift signal R/L, and are latched by latch circuit 42 by a strobe signal STB. In this way the gradient of each pixel is set in latch circuit 42. The clock signal C-CLK is counted by counter 44, and comparator 43 compares the counter value with the latched value, and gate circuit 45 stops the output of the moment counter value and the latched value match. Counter 44 is cleared by a clear signal CL. A drive voltage Vd is applied to the driver circuit 46, and output HV1~HV64 is applied to the corresponding optical shutter element based on signals D1~D64 from gate circuit 45. That is, each pixel is formed by switching ON the optical shutter elements for a time (pulse width) corresponding to the image data DATA.

The construction of the optical recording head 20 is described below with reference to FIG. 2. Polarizer 33 and analyzer 34 are disposed anteriorly and posteriorly to the optical shutter module 30, respectively. As is well known, PLZT is a ceramic having light transmitting characteristics which include an electrooptic effect of a large Kerr constant. Rectilinear light polarized by polarizer 33 is controlled the rotation of the polarizing surface by switching ON/OFF the electric field generated by a voltage applied to an optical shutter segment, so as to turn ON/OFF the light emitted from the analyzer 34. The light emitted from the analyzer 34 passes through image forming lens array 35 and dust-proof glass 36 to form a latent image on the printing paper 4.

Figure 5A:
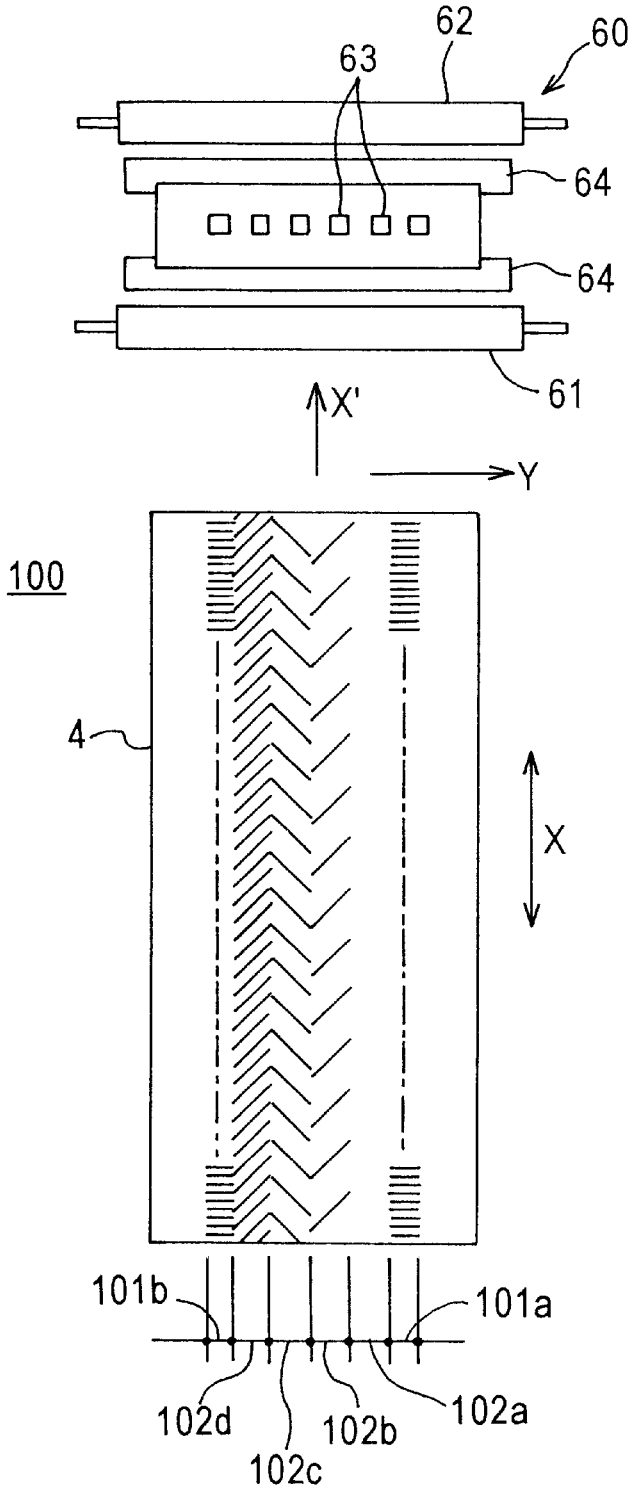
FIGS. 5(A) and 5(*b*) show the reading unit and an image pattern (first example) realizing the light quantity measuring method of the present invention, and are a plan view and a side view, respectively.
Figure 5B:
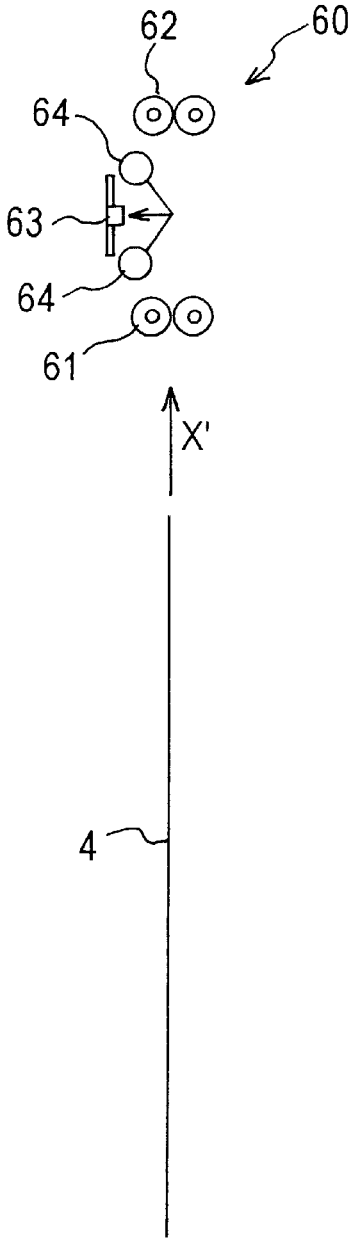
Figure 7:
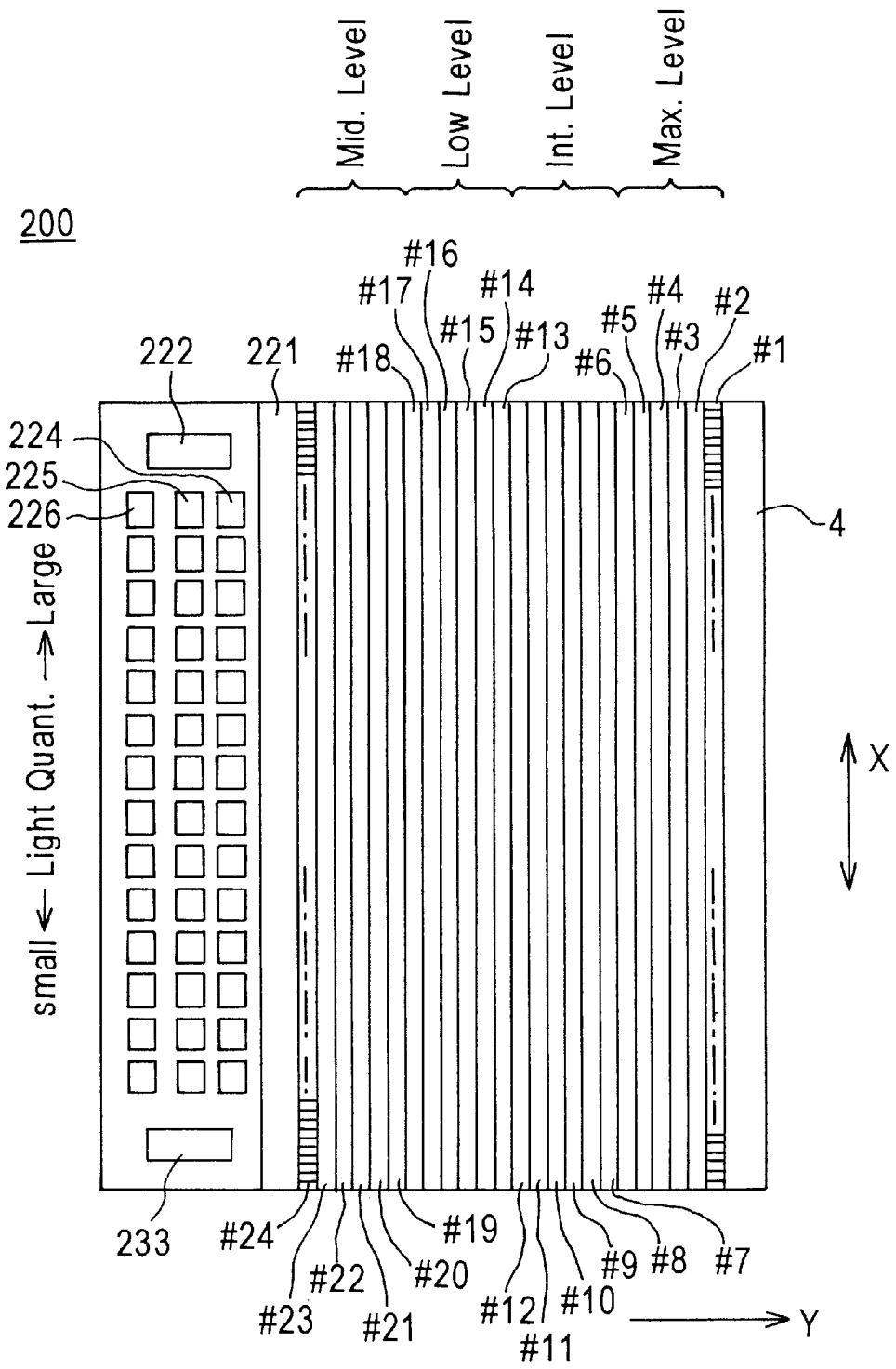
FIG. 7 is a plan view of an image pattern (second example) realizing the light quantity measuring method of the present invention.
Figure 8:
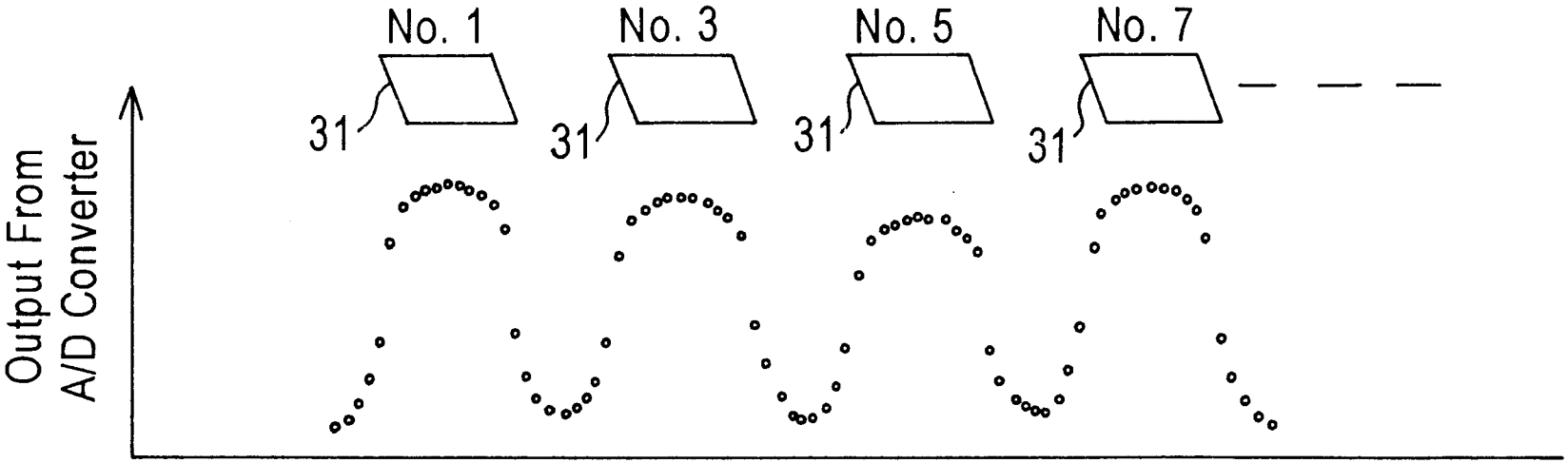
FIG. 8 is a waveform diagram of the measurement signals of a monitor image.

The construction of the image reading unit 60 is described below with reference to FIGS. 5(A) and 5(B). Image reading unit 60 is for reading a monitor image pattern 100 (first example) or pattern 200 (second example: FIG. 7) formed on printing paper 4, and for measuring the reflected light intensity of image pattern 100 or 200. Image reading unit 60 is provided with a plurality of photosensors (charge-coupled devices (CCD) or photodiodes) 63 and illumination lamps 64, 64 between the palrs of transport rollers 61 and 62. Printing paper 4 having the image pattern 100 or 200 is inserted between the pair of rollers 61 in the direction of arrow X', and the reflective light intensity of the image is measured by photosensors 63. Photosensors 63 are disposed in correspondence with the number of the image pattern lines (i.e., six columns in image pattern 100, and twenty-eight columns in image pattern 200).

Figure 6:
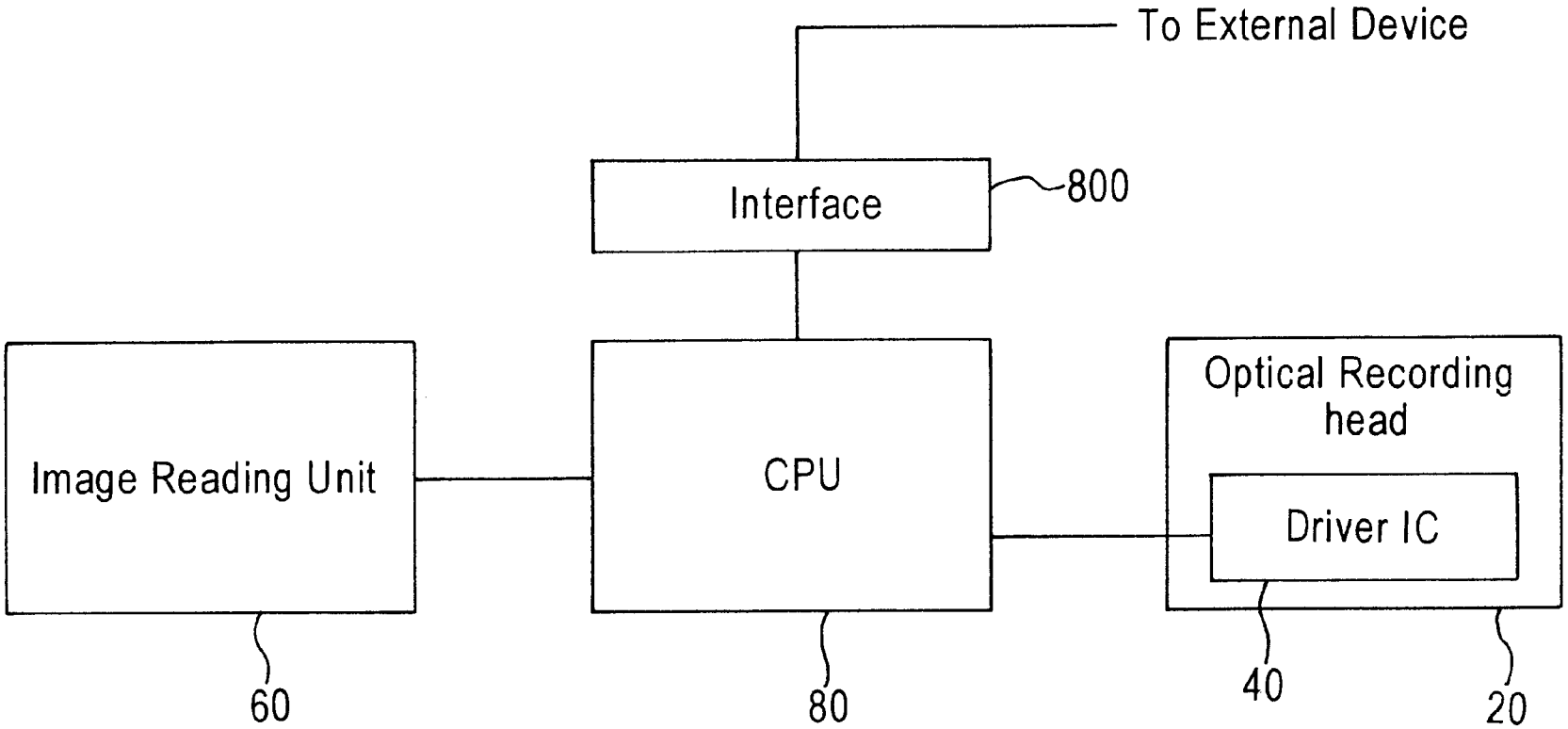
FIG. 6 is a block diagram showing the construction of the control circuit.

FIG. 6 is a block diagram showing the construction of the control circuit in the color printer of the aforesaid construction. The color printer is provided with a central processing unit (CPU) 80 which controls the overall apparatus, said CPU 80 being connected to optical recording head 20 and image reading unit 60. CPU 80 is also connected to interface 800, and can be connected to an external device such as, for example, a personal computer, via said interface 800. CPU 80 receives image signals and command signals from the external device, and transmits report signals to said external device.

CPU 80 performs desired image processing on the image signals received from the external device, and outputs said processed signals to the driver IC 40 of the optical recording head 20, and thus optical recording head 20 executed image formation. As described later, CPU 80 also generates image data based on data stored in an internal memory in the CPU 80, and executes the output of an image corresponding to said image data, i.e., image pattern 100 or 200, to the optical recording head 20. CPU 80 generates correction data via desired calculations on the measurement results of the image pattern 100 or 200 obtained from the image reading unit 60, and stores said correction data in the internal memory in CPU 80.

Measuring the amount of light is accomplished by forming the monitor image pattern 100 (first example) shown in FIG. 5 or the monitor image pattern 200 (second example) shown in FIG. 7 on the printing sheet 4, and measuring the reflected light intensity of image pattern 100 or 200 via image reading unit 60. As previously described, these are a series of operations, managed and executed by CPU 80. Of course, an operator performs the action of placing the printing sheet bearing the monitor image pattern 100 or 200 in the image reading unit 60. Measurement by the image reading unit 60 is accomplished by scanning the image pattern 100 or 200 in the direction X' which was the main scan direction at the time the image formation was executed.

The measurement results obtained by the image reading unit 60 are input to CPU 80. CPU 80 performs necessary calculations on the image data of the measurement results and generates correction data, transmitted to the drive circuit of the optical recording head 20 during subsequent printing. The measurement of the amount of light is executed periodically when the power source is first turned ON, and when printing paper 4 are replenished. Of course, an operator may optionally execute this process at any time as necessary.

Image patterns 100 or 200 are now described. In this description, the main scan direction of the optical recording head 20 is in the arrow X direction, and the transport direction (subscan direction) of the printing paper 4 at the time of image formation is in the arrow Y direction. Image pattern 100 (first example) comprises two columns of a first marker image 101*a* and second marker image 101*b* in anterior and posterior positions in the subscan direction, and four light quantity detection images 102*a*, 102*b*, 102*c*, and 102*d* formed between said two marker images. The two marker images 101*a* and 101*b* are images formed with a width of several millimeters in the subscan direction Y by thinned lighting of odd number (or even number) optical shutter elements. Light quantity detection images 102*a*~102*d* are images formed with a width of several millimeters in the subscan direction Y by lighting all optical shutter elements of the measurement object at four lighting levels (densities). In FIG. 5(A), the oblique lines represent the variable densities of the images 102*a*~102*d*. Image 102*a* is a minimum density level with all optical shutter unlighted, and is used to measure the amount of leakage light of the optical shutter elements. Image 102*b* is a low density level, image 102*c* is an intermediate density level, and image 102*d* is a high density level. Image data corresponding to the image pattern 100 are stored in the internal memory in CPU 80.

When printing paper 4 bearing the image pattern 100 formed as described above is inserted into the image reading unit 60 in the direction indicated by the arrow X', each of the images 101*a*, 101*b*, 102*a*~102*d* are illuminated by lamp 64, and the amount of light reflected therefrom is measured by the various photosensors 63. Image reading unit 60 may have a width corresponding to the widths of the marker images and the light quantity detection images in the subscan direction, so as to provide a compact image reading unit 60. When forming the image pattern 100, it is permissible to only light the optical shutter elements corresponding to the width dimension of the printing paper 4 loaded in the printer.

Since there is a pronounced difference in density between the lighted part and unlighted part of the marker images 101*a* and 101*b*, the printing position, i.e., the position of the lighted optical shutter elements can be accurately identified (addressed) by selecting the measured peak values. The address of the position of unlighted optical shutter elements may correspond to the measured minimum value, or correspond to the position halfway between the peak values. The marker images need not thin and light even number or odd number optical shutter elements, but rather may thin and light optical shutter elements at predetermined equal-spaced intervals (e.g., 8×n elements), may identify the position of the lighted elements corresponding to the measured peak values, and identify the positions of the unlighted elements by the equal spacing between peak values. Since optical shutter elements have a predetermined spacing between elements and the correspondence between said elements and the printed pixel is precise, the address of the unlighted pixels may be accurately calculated without addressing the lighted elements.

The optical shutter elements can be addressed using either marker image 101*a* or 101*b*. The formation of two columns makes it possible to accurately identify positions when an operator inserts the image pattern 100 at an inclination in the image reading unit 60 by comparing the measurement results for the two columns of the marker images 101*a* and 101*b* and detecting skewing of the images. Furthermore, it is also possible to correct printing distortion and irregular transport of the image pattern 100 by the roller pairs 61 and 62.

The amount of reflected light from the light quantity detection images 102*a*~102*d* are detected by the four center photosensors 63 among the six column of photosensors 63, and CPU 80 determines the amount of light of each optical shutter element in conjunction with the address position of the marker images 101*a* and 101*b*, and generates light correction data for each said optical shutter element. Since the light quantity is measured with all elements lighted, the light quantity of each element is measured including the influence of light from adjacent elements. In other words, the light quantity found in actual practice can be accurately calculated, and used to effectively eliminate irregular density when reproducing solid images.

Optical recording head 20 is capable of printing images having 256 halftones. Recording head 20 possesses linear light output characteristics, and if the light quantity is designated [0] when unlighted, specific individual light quantity levels (density) can be output and the reflected light intensity measured so as to produce accurate light quantity correction even at multiple levels. In actual practice, however, there does not exist and optical shutter element which has linear gradient characteristics. Therefore, four levels are output for each optical shutter element, and the measured light quantities approach a cubic curve so as to allow the generation of correction data by determining the correction coefficient for each level.

The optical recording head 20 used in the present embodiment is used for full color reproduction, but requires only white color images in the case of monochrome reproduction. Even when used for full color reproduction, characteristics of primary colors are identical or similar, for example, an image may be formed only with green (G) light to prepare correction data. The light quantity detection images 102*a*~102*d* may be formed in the aforesaid three colors to generate correction data, in which case the light quantity detection images would comprise a total of 12 images, i.e., 4 gradient levels by 3 colors.

Other methods include forming a gray image pattern via exposure by RGB colors using the optical recording head 20, and resolving said pattern into three colors via a photosensor provided with a BGR filter to accomplish measurement, or generating correction data for each color by high-speed switching of the light source color of the illumination lamp and measuring the three colors. PLZT is excellent for such use inasmuch as it provides different quantities of transmitted light in accordance with the wavelength of the light.

Each pattern formed in this way have a width of several millimeters, such that the total width of the patters is several centimeters. Therefore, it is possible to measure the light quantity of all optical shutter elements using a detection device having a narrow width (i.e., fewer number of detection elements) by scanning in a direction (main scan direction during recording) 90 degree from the direction (subscan direction) in which the sensitive member is scanned during recording.

Since a plurality of detection elements correspond to a single pattern when a high density CCD line sensor is used, a plurality of reflected light intensity can be simultaneously measured, and accurate measurement can be obtained by an averaging process.

Methods which generate light quantity correction data from measured reflected light intensity and provide feedback to the drive circuit of the optical shutter elements during subsequent image formation are well known in this field of the art. For example, the aforesaid correction data may be stored in the internal memory of CPU 80, corrected based on correction data in image signals input from an external device, and the corrected image signals then output to the optical recording head 20.

Image pattern 200 (second example) shown in FIG. 7 is described below. The image data of image pattern 200 is also stored in the internal memory in CPU 80. Image pattern 200 comprises a total of 24 light quantity detection images (patterns #1~#24) arrayed in the subscan direction Y by lighting the odd number and even number optical shutter elements at four levels for R, G, B and forming said total of 24 light quantity detection images on printing paper 4. Furthermore, strip-like intermediate tone image 221 formed by green light, patch-like gray image 222, patch-like black image 223, and images 224, 225, and 226 formed by blue light, green light, and red light respectively are formed. Each images 224, 225, and 226 contains different intensities by gradually changing the light quantity from large to small in the main scan direction X.

Among the light quantify detection images, patterns #1~#6 are maximum light level, patterns #7~#12 are intermediate light level, patterns #13~#18 are low light level, and patterns #19~#24 are minimum light level (OFF); patterns #1, #7, #13, and #19 are images formed by lighting odd number elements with blue light, patterns #2, #8, #14, and #20 are images formed by lighting even number elements with blue light, patterns #3, #9, #15, and #21 are images formed by lighting odd number elements with green light, patterns #4, #10, #16, and #22 are images formed by lighting even number elements with green light, patterns #5, #11, #17, and #23 are images formed by lighting odd number elements with red light, and patterns #6, #12, #18, and #24 are images formed by lighting even number elements with red light.

In a second example of image pattern 200, the address and light quantity of each optical shutter element is determined by patterns #1~#24. The address and light quantity of all elements can be determined by combining the measurement results of odd number and even number elements. In thinned lighting image formation, there is ideally a complete lack of density at positions corresponding to unlighted elements, but in reality there is light leakage from the unlighted elements as well as light from the adjacent lighted elements such that some density exists for unlighted elements. The measured reflected light intensity includes the leaked light and surrounding light information when generating correction data so as to obtain excellent images without density irregularities.

In image reading unit 60, a plurality of samplings are executed on the optical shutter elements 31 (the model illustrated shows odd number elements lighted) and the photosensor 63 output is subjected to analog-to-digital (A/D) conversion and transmitted to CPU 80. The peak values are detected among the sample values, and the timing of the maximum value is the element position, and the output value at this time is set as the light quantity.

In the aforesaid thinned lighting method, the output image at the minimum level has extremely low density and does not function as a marker. Therefore, the minimum output values between lighted elements at other levels may be regarded as minimum level light quantities. Eliminating the minimum light quantity patterns #19~#24, a total of 18 light quantity detection images are formed.

A modification of the thinned lighting method, achieves it objective by forming a total of 12 light quantity detection images by outputting patterns of alternating maximum and minimum light quantity levels, and outputting patterns of alternating intermediate and minimum light quantity levels.

As described in the image pattern 100 of the first example, a single gradient may be measured when the output characteristics of the optical shutter elements are linear, or the a single specific color or gray color may be printed to generate correction data.

Image pattern 200 of the second example combines the patterns #1~#24 with the maker images 101*a* and 101*b* of the first example. Measurement can be accomplished without hindrance when the width dimension of the patterns #1~#24 in the subscan direction Y are of a certain magnitude in regard to skewed insertion of a sheet into the image reading unit 60. When the number of peaks and number of samples to measured peaks are monitored, the degree of abnormality of skewing can be calculated to generate a warning to reread or reprint image patterns 100 and 200.

Image pattern 200 of the second example can extend the normal operating time of a printer to a maximum level by forming monitor images of various types on a single printing paper 4, including an image for correcting light quantity imbalance, but also as an image for correcting halftones and an image for correcting focal position of each element, an image for correcting color reproducibility and gamma characteristics (halftone characteristics), an image for confirming resolution, and an image for managing processing fluids.

When the light measuring mode is executed by multi-level reproduction driver IC 40, image data are stored in the internal memory of CPU 80 and said measurement executed based on said data. A predetermined light quantity may be specified by the data signal DATA via dip switches or the like, such that said data are transmitted to shift register 41 and subsequently latched by strobe signal STB to generate a duty corresponding to said data signal DATA via comparator 34 or the like, and operate predetermined optical shutter elements at predetermined light quantities via the gate signal GATE. Such thinned lighting signals may be repeating signals so as to be realized by a relative simple circuit.

When the optical shutter elements are divided into odd number columns and even number columns and the DATA of one column is designated "H" beforehand, thinned lighting can be readily realized, and controls are simple. The light quantities may be made variable by changing the setting of dip switches or the like.

Other Embodiments

The image forming apparatus and light quantity measuring method of the present invention are not limited to the previously described embodiments, and may be variously modified insofar as such modification does not depart from the scope of the invention.

In particular, it is to be noted that materials other than PLZT are usable as the image forming element used for optical recording, including light-emitting diodes (LED), liquid crystal shutters (LCS), deformable mirror devices (DMD), fluorescent device (FLD) and the like. Further to this, heat generating element used in a thermal printer and ink drop expelling element used in an ink jet printer may also applicable as the image forming element of the present invention.

Although the present invention has been described in terms of examples of measuring reflected light intensity of a monitor image in the aforesaid embodiments, it is to be understood that transmitted light intensity may be measured when using light transmitting materials such as, for example, film and the like as a recording medium in measuring a marker image and light quantity detection image. Furthermore, image reading unit 60 may be provided in processing unit 3, so as to measure reflected light intensity and transmitted light intensity directly after developing an image. Alternatively, an improved film scanner installed in a film printer may be used as reading unit 60.

The present invention is not only applicable to image recording devices using printing paper with silver salt sensitivity, and is also applicable to image recording devices which record on silver salt film, electrophotographic photosensitive member, or a plain paper and image projecting devices which display an image on a display. That is, various types of image bearing member can be applicable to the present invention.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A method for measuring optical quantity of an image formed by an array of image forming elements arranged in a main scan direction, said method comprising the steps of:

(a) forming an image on an image bearing member by using the array of the image forming elements, the image extending in an extending direction being parallel to the main scan direction when the image is formed; and (b) sensing intensity of the image on the image bearing member by a photosensor with moving the image bearing member relative to the photosensor in the extending direction.

2. The method of claim 1, wherein the image includes a first part for identifying positions of the image forming elements with respect to the main scan direction and a second part for evaluating optical quantities of a plurality of portions of the image corresponding to the image forming elements, respectively, said first part being located beside of the second part with respect to a direction orthogonal to the extending direction.

3. The method of claim 2, wherein the first part of the image includes a plurality of lines aligned in the extending direction.

4. The method of claim 2, wherein said photosensor includes a first photosensing element for sensing the first part and a second photosensing element for sensing the second part.

5. The method of claim 2, wherein said second part includes a first color image of a first color and a second color image of a second color.

6. The method of claim 5, wherein each image forming element is a light shutter element which controls transmission of light emitted from a light source, and wherein said step (a) further comprises:

(a-1) controlling transmission of light of the first color by controlling the light shutter elements, and thus forming the first color image on the image bearing member; and (b-1) controlling transmission of light of the second color by controlling the light shutter elements, and thus forming the second color image on the image bearing member.

7. A measuring apparatus for measuring optical quantity of an image by an array of image forming elements arranged in a main scan direction, comprising:

a transporter which transports an image bearing member on which an image is previously formed by the image forming elements, said image being extending in an extending direction having been parallel to the main scan direction when the image was formed, said transporter transports the image bearing member in a transporting direction parallel to the extending direction; and a photosensor which senses intensity of the image of the image bearing member transported by said transporter.

8. The measuring apparatus of claim 7, wherein the image includes a first part for identifying positions of the image forming elements with respect to the main scan direction and a second part for evaluating optical quantities of a plurality of portions of the image corresponding to the image forming elements, respectively, said first part being located beside of the second part with respect to a direction orthogonal to the extending direction.

9. The measuring apparatus of claim 8, wherein said photosensor includes a first photosensing element for sensing the first part and a second photosensing element for sensing the second part, said first photosensing element and said second photosensing element being aligned in an aligned direction orthogonal to the transporting direction.

10. The measuring apparatus of claim 8, wherein said second part includes a first color image of a first color and a second color image of a second color.

11. The measuring apparatus of claim 10, wherein said photosensor includes a first photosensing element for sensing the first part, a second photosensing element for sensing the first color image, and a third photosensing element for sensing the second color image, said first, second and third photosensing elements being aligned in an aligned direction orthogonal to the transporting direction.

12. A method for forming a test image for measuring unevenness of image forming elements arranged in a main scan direction, said method comprising:

(a) forming a first image on an image bearing member by using said image forming elements, said first image being for identifying positions of the image forming elements with respect to the main scan direction;

(b) forming a second image on the image bearing member by using said image forming elements, said second image being for evaluating optical quantities of a plurality of portions of the image corresponding to the image forming elements;

(c) forming a third image on the image bearing member by using said image forming, elements, said third image being for evaluating for identifying positions of the image forming elements with respect to the main scan direction, said second image being formed between said first and third images with respect to a sub scan direction orthogonal to said main scan direction.

13. A method for forming a test image for measuring unevenness of image forming elements arranged in a main scan direction, said method comprising the steps of:

(a) forming a first image on an image bearing member by using said image forming elements, said first image being for identifying positions of the image forming elements with respect to the main scan direction; and (b) forming second and third images on the image bearing member by using said image forming elements, each of said second and third images being for evaluating optical quantities of a plurality of portions of the image corresponding to the image forming elements, said second image being different than said third image in color.

14. A method for forming a test image for measuring unevenness of image forming elements arranged in a main scan direction, said method comprising the steps of:

(a) forming a first image on an image bearing member by using said image forming elements, said first image being for identifying positions of the image forming elements with respect to the main scan direction; and (b) forming second and third images on the image bearing member by using said image forming elements, each of said second and third images being for evaluating optical quantities of a plurality of portions of the image corresponding to the image forming elements, said second image being different than said third image in density.

15. A method for forming a test image for measuring unevenness of image forming elements arranged in a main scan direction, said method comprising the steps of:

(a) activating odd numbered image forming elements, thus forming, in the main scan direction, a first image on an image bearing member, the image forming elements and the image bearing member moving relative to each other in a sub-scan direction; and (b) activating even numbered image forming elements, thus forming a second image, in the main scan direction, on the image bearing member, the second image being at a different position in the sub-scan direction than the first image.

* * * * *